United States Patent [19]

Hoult

[11] 4,150,704

[45] Apr. 24, 1979

[54] METHOD OF PRODUCING SAND MOUNDS HAVING A FROZEN SURFACE

[75] Inventor: Frederick H. Hoult, Sheffield, England

[73] Assignee: W. H. Booth & Co., Ltd., England

[21] Appl. No.: 926,820

[22] Filed: Jul. 21, 1978

Related U.S. Application Data

[63] Continuation of Ser. No. 712,645, Aug. 9, 1976, abandoned.

[30] Foreign Application Priority Data

Aug. 14, 1975 [GB] United Kingdom ..... 33989/75

[51] Int. Cl.[2] ..... B22C 1/00

[52] U.S. Cl. ..... 164/12; 164/15; 164/37; 164/41

[58] Field of Search ..... 164/8, 12, 15, 37, 41

[56] References Cited

U.S. PATENT DOCUMENTS

| | | | |
|---|---|---|---|
| 2,476,726 | 7/1949 | Haas | 164/37 |
| 3,159,505 | 12/1964 | Burgess et al. | 164/41 X |
| 3,330,674 | 7/1967 | Santmyer | 164/41 |
| 3,512,571 | 5/1970 | Phelps | 164/37 |

FOREIGN PATENT DOCUMENTS

| | | | |
|---|---|---|---|
| 428843 | 10/1974 | U.S.S.R. | 164/15 |

*Primary Examiner*—Robert D. Baldwin

*Attorney, Agent, or Firm*—Lowe, King, Price & Becker

[57] ABSTRACT

A method of producing a mould of particulate material comprises admixing the particulate material with a controlled quantity of water, compacting the mixture to the required shape on a pattern or the like, removing the compacted mass from the pattern, and directing at at least the surface of the compacted mould to be contacted by molten metal a stream of coolant, whereby at least that surface is frozen to a depth sufficient to withstand the conditions imposed during the pouring of molten metal into the mould.

21 Claims, 1 Drawing Figure

METHOD OF PRODUCING SAND MOUNDS HAVING A FROZEN SURFACE

Figure 1:
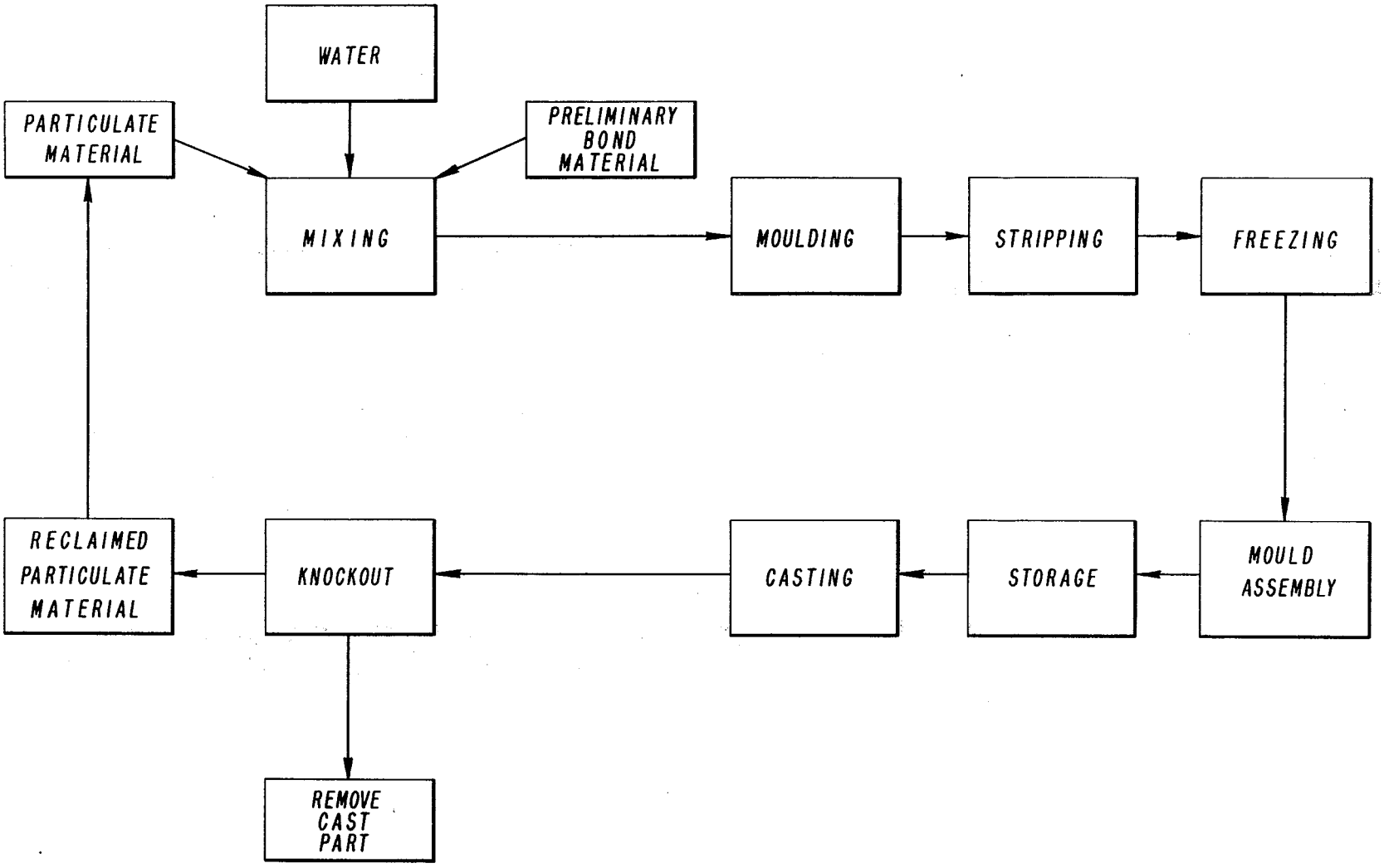

This is a continuation, of application Ser. No. 712,645, filed Aug. 9, 1976, now abandoned.

This invention relates to moulds of particulate material, e.g., sand for the casting of molten metal and to their methods of production.

Conventionally, the casting of molten metal into sand moulds has had, amongst others, two criteria deemed necessary to be satisfied, one being that the particulate sand material should be held in its required shape to allow casting to proceed and the second that as much sand as possible should be recovered from a used mould. Hitherto, those two objectives have tended to be self-defeating. To ensure that a sand mould has sufficient strength it is known to treat the sand or the mould formed from the sand either by firing the mould or by introducing additional materials to produce a chemical bond or allow, e.g., $CO_2$ hardening to cause or facilitate hardening of the mould. Whilst these methods have the desired effect on mould strength, they are not conducive to the reclamation of the mould material.

According to the present invention, a method of producing a mould of particulate material, comprises admixing the particulate material with a controlled quantity of water, compacting the mixture to the required shape on a pattern or the like, removing the compacted mass from the pattern, and directing at at least the surface of the compacted mould to be contacted by molten metal a stream of coolant, whereby at least that surface is frozen to a depth sufficient to withstand the conditions imposed during the pouring of molten metal into the mould.

Preferably the mixture prior to compaction is provided with a relatively small amount of a material which does not affect reclamation of the sand and which is capable of giving the compacted mixture a preliminary bond of sufficient green strength to allow it to be stripped from the pattern. Thus, according to a further feature of the invention a method of producing a mould of particulate material comprises admixing the particulate material with a further material capable of providing a preliminary bond, compacting the mixture to the required shape on a pattern or the like, removing the compactd mass from the pattern, providing the compacted mass with a primary bond by directing at at least the surface of the compacted mould to be contacted by molten metal a stream of coolant, whereby at least that surface is frozen to create the primary bond. The nature of the material providing the preliminary bond may be such as to provide the mould with a secondary bond when molten metal is poured into the mould. Thus, a small quantity of a material such as starch may be included in a mould making batch of, e.g., sand. Adding starch has the further advantage that the handling properties of particulate material such as sand is improved, and moreover one of the distinct advantages of the invention, the absence of fume being created during casting, is not seriously affected by the addition of starch to the mixture. When utilising other particulate materials other preliminary and secondary bond forming materials can be employed such as Wyoming Bentonite, which has the advantage over starch in that no appreciable fume is created on casting. The Bentonite can be reconstituted when re-using the reclaimed particulate material simply by the addition of water.

The coolant may be air, cooled to a temperature such that on directing the air against the mould, the mould surface is frozen. It is however, preferred that the coolant applied is provided by a source of liquified gas such as nitrogen, carbon dioxide or helium. Thus the mould may be sprayed with a fine spray of liquid nitrogen or helium or blown with $CO_2$ such that so-called dry ice is deposited on the surface of the mould to be contacted by molten metal.

The primary bond formed by freezing can be effectively created when the particulate material contains as little water as is necessary to maintain the shape of the particulate material on removal from the pattern. However, the water content has a direct effect on the permeability of the mould. For general applications it is preferred that water is in the amount up to 12% by weight based on the weight of the particulate material, although greater amounts of water can be provided for moulds which are required to have an increased thermal capacity.

With conventional freezing techniques, moulds tend to exhibit moisture loss which makes control of the moisture content of the mould at the time of casting inconsistent. By following the teaching of the invention, and directing a stream of coolant at the surface of the mould to be contacted by the molten metal, the surface temperature is reduced to a sub-zero temperature extremely rapidly, and virtually instantaneously. The very rapid cooling of that surface of the mould results in the immediate formation of a shell of frozen particulate material behind which lies an unfrozen mass.

With thin-walled moulds it is obviously prudent to completely freeze the mould, but with moulds of appreciable thickness completely freezing the mould is not necessary so long as there is sufficient depth of frozen sand on all faces that will be contacted by molten metal during pouring and solidification of a casting. Preferably all faces of a mould of appreciable thickness are frozen, with the possible exception of the back face to improve the strength of the mould.

Freezing may take place such that the temperature of the mould is reduced into the range −1° C. to −269° C. It is however preferred to freeze at least the surface of the mould to be contacted by molten metal to a temperature below −20° C., and prior to casting to allow the mould to warm up such that at least that surface has a temperature of −10° C. to −20° C. at the point in time that casting takes place.

Thus in its frozen state, the mould exhibits more than adequate strength to facilitate handling and placing of the mould in a position to receive molten metal, and to withstand the conditions to be found during pouring and solidification.

After casting, solidification takes place before the mould has thawed, and when the mould has thawed, the mould simply collapses from around the casting when all the particulate material including any unburned primary and secondary bond forming materials can be reclaimed and re-used.

FIG. 1 is a flow diagram of the method steps of the invention.

The invention can be applied to a wide range of mould making particulate materials such as silica sand, zircon sand, olivine sand, with the mould making material graded in convention manner. As the preliminary bond, any binder compatible with the material of the mould can be utilised and which does not disturb the non-fuming characteristic of the frozen moulds. Thus water itself may serve as a temporary bond or a binder such as starch or bentonite may be included. The mould making material may comprise 88% to 99% by weight of particulate mould forming material, 1% to 12% by weight water and if desired 1% to 4% by weight of a binder.

The mould making batch is first thoroughly mixed and then applied to a pattern either by hand ramming or strickling, blowing and strickling, jolt squeezing, or by the use of any other appropriate green sand or cold setting moulding technique.

The pattern used can be of any suitable material such as metal, wood or synthetic resin. With metal patterns it is preferred that a non-corrosive surface is provided, and in the case of a wooden pattern that the operative surface is water proofed. If desirable the operative surface of the pattern may be dusted with a small amount of parting powder or sprayed with a releasing agent to facilitate subsequent stripping.

Once the mould making batch has been compacted on the pattern, a flat base plate of, e.g., a light metal alloy, and which is preferably perforated, is placed on the exposed back surface of the mould and the assembly turned over so that the weight of the mould is supported by the base plate. The pattern is then removed with, if required, slight vibration, and the base plate and mould frozen immediately after stripping by directing a stream of coolant against the exposed surface of the mould. Once frozen either totally or to an extent sufficient to withstand substantial handling of the mould and casting therein, the moulds are assembled in generally conventional manner, with normal provision being made as regards runners and the like.

When frozen moulds cannot be used immediately, they may be stored at lower temperature, although frozen moulds can withstand the general environment of a foundry for an appreciable amount of time before they would become sufficiently unstable to prevent pouring taking place.

After the molten metal has been poured there is a very rapid solidification at least on the surface of the casting, ensuring that the casting assumes a stable form well before the mould has heated up to an extent that would cause the mould to collapse. Knock-out of the casting should preferably take place as soon as possible after casting, i.e. immediately after the metal has solidified and before all the sand has thawed. Thus, the mould can be gently vibrated to remove frozen and loose mould forming material from around the casting leaving a layer of warmer and dry bonded mould forming material immediately adjacent the casting. It is preferred that this proportion of the mould making material is returned immediately to a mixer. After casting has cooled down, it may be vibrated to a greater degree to remove substantially all the remaining adhering mould making material. This somewhat hotter material may also be returned to the mixer such that the net result is that the material returned in total to the mixer is considerably cooled by the frozen content, but not chilled. This allows effective compaction of the material on the next pattern and more effective useage of the coolant to freeze already cooled mixture.

The following are three examples of moulds made in accordance with the invention:

EXAMPLE 1

To cast a 20 mm pressure reducing valve body in S.G. Iron 27/12 weighing 5.5 lbs., a mixture of zircon sand 97.7% by weight, bentonite 1% by weight and water 1.3% by weight was hand rammed on to a wooden pattern to a maximum depth of 2'4" and strickled. The half mould weighing 19 lbs. having a permeability of 80 and a green compression strength of 2.4 lbs. p.s.i. was turned out on to a perforated aluminium base plate and the whole covered with a fine layer of solid $CO_2$ particles. After five minutes two frozen half moulds having a face temperature of −70° C. were clamped together with two $CO_2$ silicate sand cores. The assembly was then taken into the foundry and cast. The tensile strength of the sand mixture used averaged 125 lbs. p.s.i., and the temperature of the mould surface on casting was recorded at −20° C.

EXAMPLE 2

To cast a gear wheel weighing approximately 2.1 lbs. in aluminium bronze a mixture of Mansil 55 silica sand (96.7%) starch (1%) and water (2.3%) was used. The permeability of this mixture was rated at 210, and the green compression strength at 0.8 lbs. p.s.i. No core was required for this casting, and two half moulds of maximum thickness 1'4" and weighing 2 lbs. and 3.0 lbs. respectively were frozen by placing the stripped moulds on a base plate under a fine spray of liquid nitrogen. The moulds were frozen right through with a face temperature of −70° C., and at that time of casting the face temperature was −15° C.

EXAMPLE 3

To cast a number of ferro-alloy cast blocks weighing approximately 10 ozs. each, the particulate material consisted of olivine sand 96% and water 4%. As the standard of surface finish required was not high, no bentonite or other binder was used. Sand moulds weighing 10 lbs. each having a permeability of 120 and a green strength of 0.5 lbs. p.s.i. were made using this method and were frozen to −25° C. in a Mechanical Blast Freezer. After casting, the sand fell away from the castings very easily and the resultant casting needed no further cleaning.

What we claim is:

1. A method or producing a mould of particulate material comprising admixing the particulate material with a controlled quantity of water, compacting the mixture to the required shape on a pattern or the like, removing the compacted mass from the pattern, and then directing at at least the surface of the removed, compacted mould to be contacted by molten metal a stream of coolant, whereby at least that surface is frozen to a depth sufficient to withstand the conditions imposed during the pouring of molten metal into the mould.

2. A method as in claim 1 wherein, the mixture prior to compaction is provided with a relatively small amount of a material which does not affect reclamation of the sand and which is capable of giving the compacted mixture a preliminary bond of sufficient green strength to allow it to be stripped from the pattern.

3. A method as in claim 1, wherein the coolant is air, cooled at a temperature such that on directing the air against the mould, the mould surface is frozen.

4. A method as in claim 1, wherein the coolant is provided by a source of liquified gas such as nitrogen, carbon dioxide or helium.

5. A method as in claim 1, wherein the particulate material has a water content of up to 12% by weight.

6. A method as in claim 1, wherein the mould is completely frozen.

7. A method as in claim 1, wherein the mould is frozen in the range −1° C. to −269° C.

8. A method as in claim 7, wherein the mould is frozen such that at least the surface of the mould to be contacted by molten metal has a temperature below −20° C., and prior to casting allowing the mould to warm up such that at least that surface has a temperature of −10° C. to −20° C. at the point in time that casting takes place.

9. A method as in claim 1, wherein the particulate mould making material is silica sand.

10. A method as in claim 1, wherein the particulate mould making material is zircon sand.

11. A method as in claim 1, wherein the particulate mould making material is olivine sand.

12. A method as in claim 1, wherein the mould making batch comprises 88% to 99% by weight of particulate mould forming material, 1% to 12% by weight water and 1% to 4% by weight of a binder.

13. A method as in claim 1, wherein the pattern is of metal provided with a non-corrosive surface.

14. A method as in claim 1, wherein the pattern is wood having a water proofed surface.

15. A method as in claim 1, wherein the pattern is of synthetic resin.

16. A method as in claim 1, wherein once the mould making batch has been compacted on the pattern, a flat base plate of a light metal alloy is placed on the exposed back surface of the mould and the assembly turned over so that the weight of the mould is supported by the base plate.

17. A method as in claim 16, wherein a flat base plate is perforated.

18. A method of producing a mould of particulate material comprising admixing the particulate material with a further material capable of providing a preliminary bond, compacting the mixture to the required shape on a pattern or the like, removing the compacted mass from the pattern then providing the compacted mass with a primary bond by directing at at least the surface of the removed compacted mould to be contacted by molten metal a stream of coolant, whereby at least that surface is frozen to create the primary bond.

19. A method as in claim 18, wherein the nature of the material providing in the preliminary bond is such as to provide the mould with a secondary bond when molten metal is poured into the mould.

20. A method as in claim 19, wherein starch is included in a mould making batch.

21. A method as in claim 19, wherein bentonite is included in a mould making batch.

* * * * *